US006533139B2

(12) United States Patent
Lukacevic

(10) Patent No.: US 6,533,139 B2
(45) Date of Patent: Mar. 18, 2003

(54) SPLASH PROOF LID ASSEMBLY

(76) Inventor: Temo Lukacevic, 268 W. 72nd St., New York, NY (US) 10023

( * ) Notice: Subject to any disclaimer, the term of this patent is extended or adjusted under 35 U.S.C. 154(b) by 14 days.

(21) Appl. No.: 09/957,327

(22) Filed: Sep. 20, 2001

(65) Prior Publication Data

US 2002/0011494 A1 Jan. 31, 2002

Related U.S. Application Data

(63) Continuation-in-part of application No. 09/545,159, filed on Apr. 7, 2000, now Pat. No. 6,296,141, which is a continuation-in-part of application No. 09/095,419, filed on Jun. 8, 1998, now abandoned.

(51) Int. Cl.[7] ..... A47G 19/22

(52) U.S. Cl. ..... 220/719; 220/713; 220/717; 222/564; 222/571

(58) Field of Search ..... 220/713, 717, 220/719, 501, 521, 703, 707, 705, 708, 711, 714, 716, 254, 256; 215/387, 388; 229/404; 222/424, 564, 571

(56) References Cited

U.S. PATENT DOCUMENTS

,908,706 A * 1/1909 Sprinkle ..... 220/713
2,914,214 A * 11/1959 Messinger ..... 220/705
3,360,161 A * 12/1967 Smith ..... 220/719
4,322,014 A * 3/1982 Philip ..... 220/713
4,394,928 A * 7/1983 Philip ..... 220/719
4,767,019 A * 8/1988 Horner ..... 220/713
4,915,250 A * 4/1990 Hayes, Jr. ..... 220/711
5,542,670 A * 8/1996 Morano ..... 220/719
6,296,141 B1 * 10/2001 Lukacevic ..... 220/713
6,305,571 B1 * 10/2001 Chu ..... 220/719

FOREIGN PATENT DOCUMENTS

GB 2053865 A * 2/1981 ..... 220/719

* cited by examiner

*Primary Examiner*—Stephen K. Cronin
*Assistant Examiner*—Niki M. Eloshway
(74) *Attorney, Agent, or Firm*—Bierman, Muserlian and Lucas

(57) ABSTRACT

A splash-proof lid assembly is a substantially planar unit which is made up of a disc and a bottom section that is rotatably connected to the disc. By rotating the bottom section to the underside of the disc, a tube is formed which allows for drinking from a cup once the lid is placed on the cup.

9 Claims, 4 Drawing Sheets

SPLASH PROOF LID ASSEMBLY

CROSS-REFERENCE TO RELATED APPLICATIONS

This application is a continuation-in-part of U.S. patent application Ser. No. 09/545,159 filed Apr. 7, 2000, now U.S. Pat. No. 6,296,141 issued Oct. 2, 2001, which was in turn, a continuation-in-part of patent application Ser. No. 09/095,419 filed Jun. 8, 1998, now abandoned.

BACKGROUND OF THE INVENTION

1. Field of the Invention

This invention relates to a removable lid for a cup and, more particularly, to a lid assembly which is used to form the lid. The lid of the present invention avoids inadvertent splashing which occurs due to unintentional movement of the cup.

2. Art Related to the Invention

Splash-proof lids for drinking cups are known. Typically, they comprise a round, removable cover which fits tightly over the top opening of a cup to prevent unwanted spillage of the contents of the cup while allowing the user to drink the contents of the cup even though the lid remains on the cup. To allow the user to drink the contents of the cup while the lid remains on the cup, both a drinking hole and an air hole are provided in the lid. Both holes are configured to prevent unwanted loss or spillage of the contents of the cup which occurs when the cup is unintentionally moved. Typically, such lids are used on disposable cups which the user takes on a train, a plane, in a boat, or in a car.

The drinking hole is usually positioned at the edge of the lid next to the side wall of the cup, while the air hole is positioned either centrally in the lid or along the edge of the lid next to the side wall of the cup, opposite the drinking hole.

One example of such a lid is taught in U.S. Pat. No. 4,322,014. In the '014 patent, a splash-proof lid has both a drinking hole and an air hole wherein both holes have a baffle arrangement to prevent the liquid contents of the cup from exiting the cup. The baffle arrangement is such that the axis of the baffle, taken along the fluid flow lines, forms a straight line and does not follow the contour or radius of the exterior of the lid. The baffle arrangement in the '014 patent is rather complicated.

In order to make the lid of the '014 patent, two separate pieces are either molded separately and then subsequently glued, or the lid is molded as one unitary piece. Molding is obviously difficult and assembling the two pieces is time-consuming.

Another example of a splash-proof lid is taught in U.S. Pat. No. 4,394,928. Here a special cup having a ledge functions with the lid to form a curved channel through which liquid flows to the drinking hole. This has the advantage of a one step molding process, but requires a special cup to allow the lid to function.

There is a need for a simplified design for a splash-proof lid which can function with a conventional disposable cup.

SUMMARY OF THE INVENTION

A simplified lid assembly for making a splash-proof lid for a cup has now been discovered. The lid is intended to be disposable and for use with disposable drinking cups such as the type used for coffee, tea, etc. The lid has an air hole, a drinking hole and is designed to avoid spillage of the contents of the cup through the drinking hole and the air hole.

It has been discovered that the jiggling or unintended movement of the cup causes a wave to form on the surface of the liquid and to travel back and forth across the surface of the liquid crashing against the side walls of the cup. When the wave hits the side walls of the cup, it splashes out of the drinking hole or the air hole when the air hole is positioned next to the side wall of the cup. Thus, it is the movement of the waves on the surface of the liquid in the cup and its crashing against the side wall that causes the splashing and the spillage of the liquid.

It has also been found that when the air hole is made small and positioned in the center of the lid that splashing or spillage due to the wave through the air hole does not occur. Furthermore, it has been found that when the air hole is made rather small compared to the drinking hole, that the air hole will still function to allow liquids to flow out of the drinking hole and air in through the air hole. Thus, in the present invention, the air hole is positioned in the center of the lid and made relatively small compared to the drinking hole.

To avoid spillage out of the drinking hole, an arched tube is employed in fluid communication with the drinking hole. The arched tube of the present invention blocks the wave from crashing directly into the drinking hole and redirects the liquid back into the cup to prevent spillage of the contents of the cup through the drinking hole.

The arched tube extends above and below the planar surface of the lid so as to form a chamber. The drinking hole is positioned in the top of the tube and the top of the tube rises above the planar surface of the lid. The bottom of the tube extends below the planar surface of the lid and contains inlets through which the contents of the cup travel to reach the drinking hole. The arched tube follows the curvature of the lid, is centered on the drinking hole, and is in fluid communication with the drinking hole. The arched tube is formed along the edge of the lid and has a plurality of inlets to allow the liquid contents of the cup to travel into the tube. The inlets can be in the bottom of the tube, in the end walls of the tube, or both. The drinking hole is positioned in the top of the tube to allow the liquid contents to flow from the cup through the tube and into the user's mouth. The radius of the tube is less than the radius of the lid and the radius of the tube is concentric with the radius of the lid. The lid itself has an engaging periphery to allow it to engage with the rim of a cup and become removably affixed to the rim of the cup. In this way, the lid of the present invention fits a conventional disposable cup and no special cup must be employed with the lid of the present invention.

It has been discovered that the lid of the present invention can be easily made in a one step molding process from a unique lid assembly which is disclosed herein. The lid assembly is made up of two pieces, one piece being the disc that makes up the majority of the lid while the other piece is a bottom section which forms the bottom portion of the arched tube and a portion of the engaging periphery. The disc and the bottom section are rotatably connected to one another along their peripheries such that the lid is assembled by rotating the disc and the bottom section together. In the molding operation, the disc and the bottom section form one, essentially planar, element.

Broadly, the splash-proof lid for a drinking cup in accordance with the present invention comprises:

- a circular disc having a snap fitting periphery for engagement with a cup rim;
- an air hole in said disc which is positioned in the center of said disc;

an arched tube adjacent said snap fitting periphery, said tube having a radius that is concentric with the radius of said disc and less than the radius of said disc, said tube having a top portion which is above the top surface of said disc and a bottom portion which is below the bottom surface of said disc;

a drinking hole in a top wall of said tube, said tube centered on said drinking hole, said air hole being smaller than said drinking hole; and at least two inlets in said tube positioned in said bottom portion of said tube, such that said inlets are in fluid communication with said drinking hole to allow a user to drink through the lid when the lid is placed on top of a drinking cup.

Broadly, the splash-proof lid assembly for making a lid for a drinking cup in accordance with the present invention comprises:

a circular disc having a periphery;

a first snap fitting periphery portion extending around a first portion of said periphery, said first snap fitting periphery portion absent from a second portion of said periphery;

a tube top portion with a drinking hole therein, said tube top portion positioned adjacent to said periphery at said second portion of said periphery, said tube top portion rising above the top surface of said disc;

an air hole positioned in the center of said disc;

a bottom section having an arcuate side, said bottom section having a second snap fitting periphery portion adjacent said arcuate side, and a tube bottom portion having at least two inlets therein, said tube bottom portion adjacent said second snap fitting periphery portion, said bottom section rotatably attached to said disc along said periphery of said disc such that when said bottom section is rotated under said disc, said second snap fitting periphery portion is positioned in said second portion of said periphery, said tube bottom portion aligns with said tube top portion to form an archede tube in said lid, said inlets are in fluid communication with said drinking hole, and said first snap fitting periphery portion and said second snap fitting periphery portion for a complete snap fitting periphery of said lid.

Preferably, the inlets are in the bottom wall of the tube, however, the inlets can also be in the end wall of the tube, provided they are in the end wall of the bottom portion of the tube, i.e. below the bottom surface of the disc.

Preferably, the arched tube forms an angle of about 30 to about 60° with respect to its radius.

BRIEF DESCRIPTION OF THE DRAWINGS

These and other aspects of the present invention may be more fully understood by reference to one or more of the following drawings wherein.

DETAILED DESCRIPTION OF THE INVENTION

Figure 1:
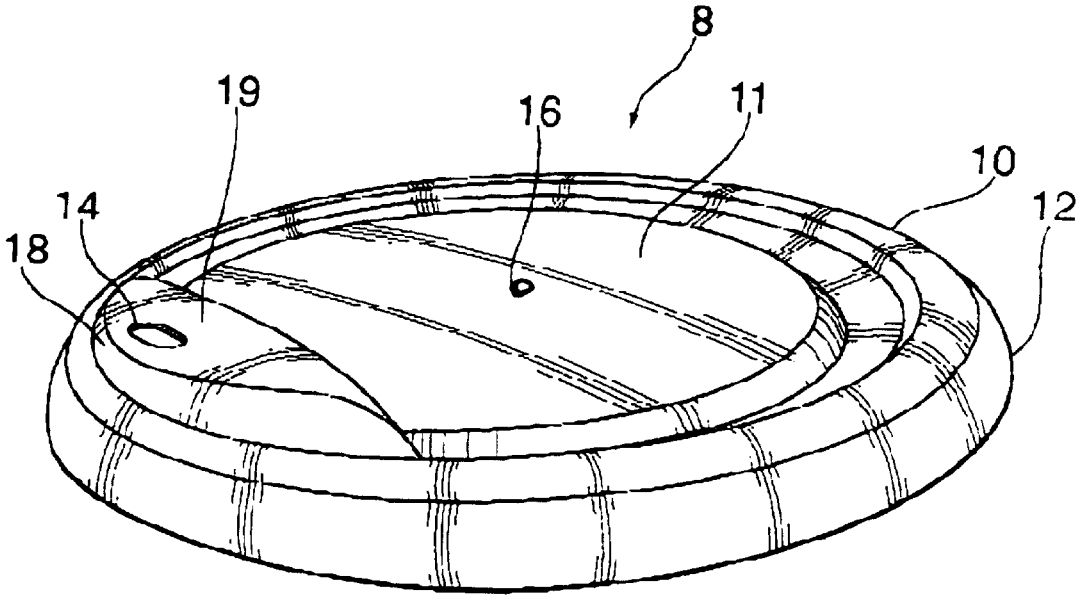
FIG. 1 is a perspective top view of the assembled lid of the present invention.

FIG. 1 illustrates a top perspective view of the assembled lid 8. Lid 8 comprises disc 10 having raised center section 11 on top thereof, snap fitting periphery 12 along the sides thereof, air hole 16 extending therethrough, and arched tube 18 with top portion 19 and having drinking hole 14 extending therethrough. Top portion 19 rises above the surface of disc 10.

Figure 2:
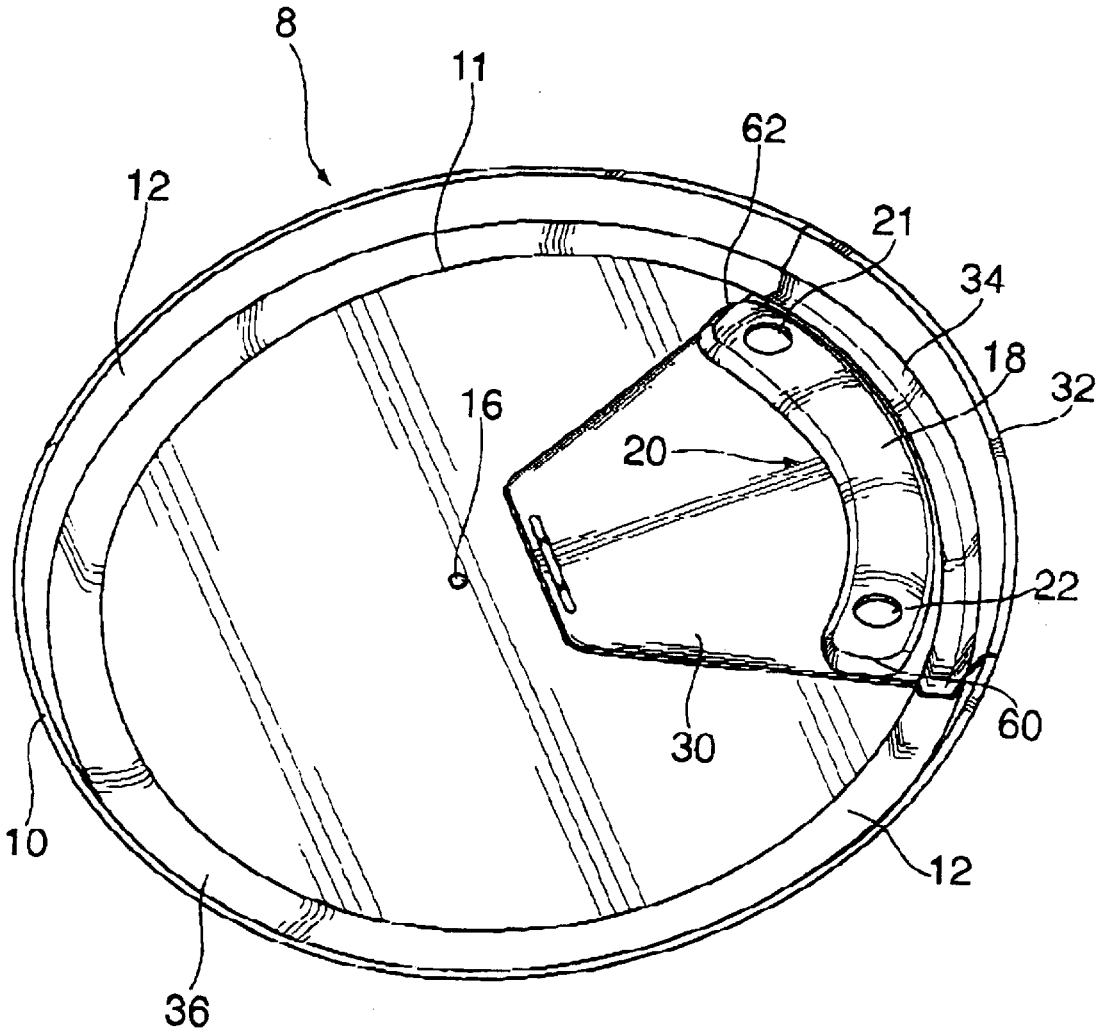
FIG. 2 is a perspective bottom view of the assembled lid of the present invention.

FIG. 2 is a perspective view of the bottom of lid 8. As shown in FIG. 2, bottom portion 20 of tube 18 is sunken below the bottom surface of disc 10. Bottom portion 20 has two inlet openings 21 and 22. Tube 18 is in fluid communication with drinking hole 14 such that when a user drinks from a cup, the liquid contents of the cup flow through inlet openings 21, 22 into tube 18, through tube 18 to drinking hole 14 and into the user's mouth.

Bottom section 30 is used to form tube 18 and a portion of snap fitting periphery 12. Bottom section 30 comprises arcuate side 32 with snap fitting periphery portion 34. Disc 10 has snap fitting periphery 36. Snap fitting periphery portion 36 along with snap fitting periphery portion 34 makes up snap fitting periphery 12.

Lid 8 is securely held on a cup due to the engagement between snap fitting periphery portions 34, 36 and the rim of the cup. This engagement between snap fitting periphery portions 34 and 36 occur when the lid 8 is pressed down onto the rim of the cup. Such snap fitting periphery portions 34, 36 are conventional and well-known to those of skill in the art. The snap fitting periphery portions 34, 36 house the lip of the cup when the two are joined.

Figure 3:
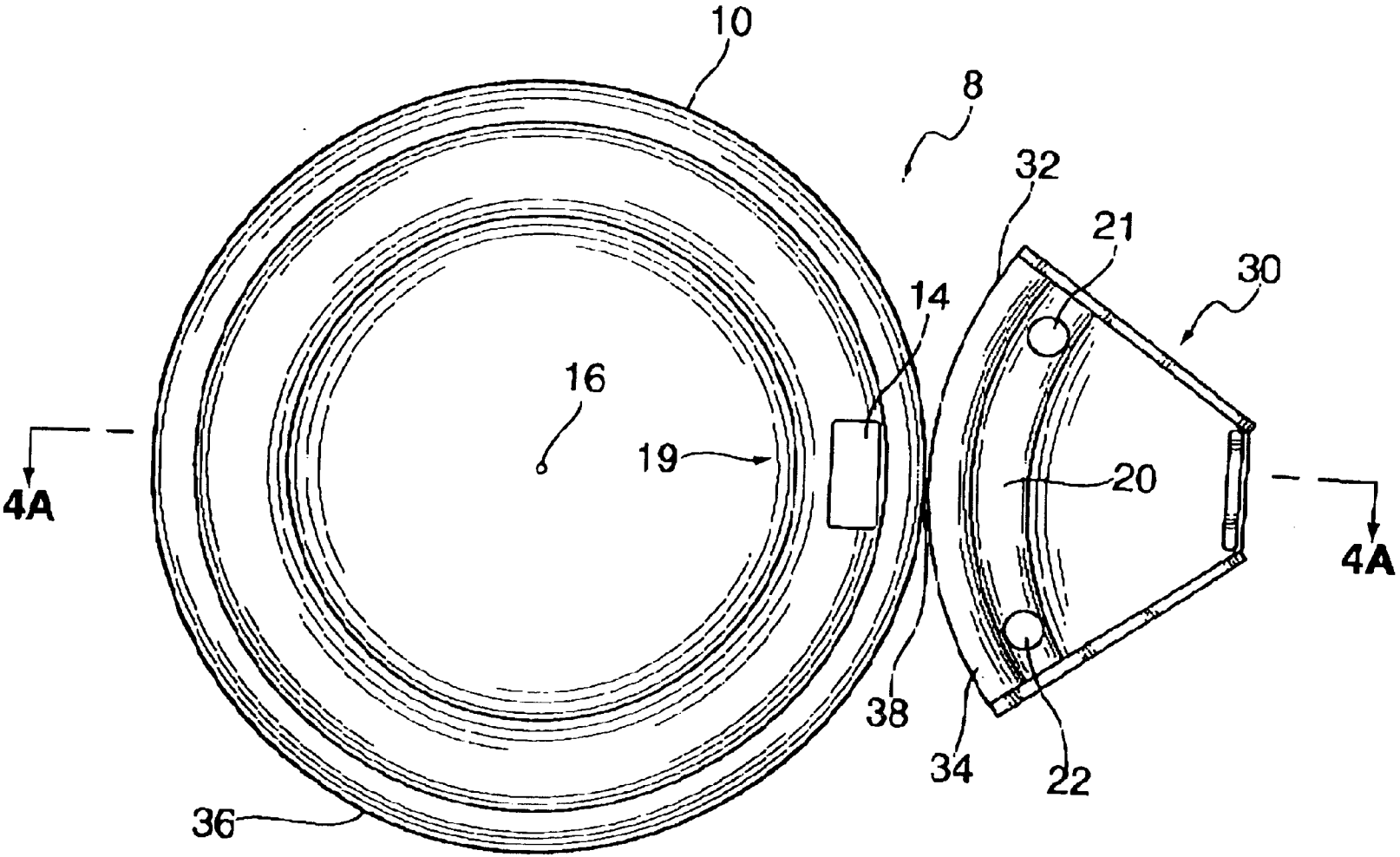
FIG. 3 is a top view of the lid assembly of the present invention.

As shown in FIG. 3, which is a top view of lid 8 unassembled into its two pieces, bottom section 30 and disc 10, bottom section 30 and disc 10 are connected along their respective peripheries at joint 38. Bottom section 30 has arched side 32 with snap fitting periphery portion 34. Bottom section 30 has bottom portion 20 which forms the bottom and a part of the lower side walls of tube 18. Inlet openings 21, 22 are shown in the bottom wall of portion 20.

Figure 4A:
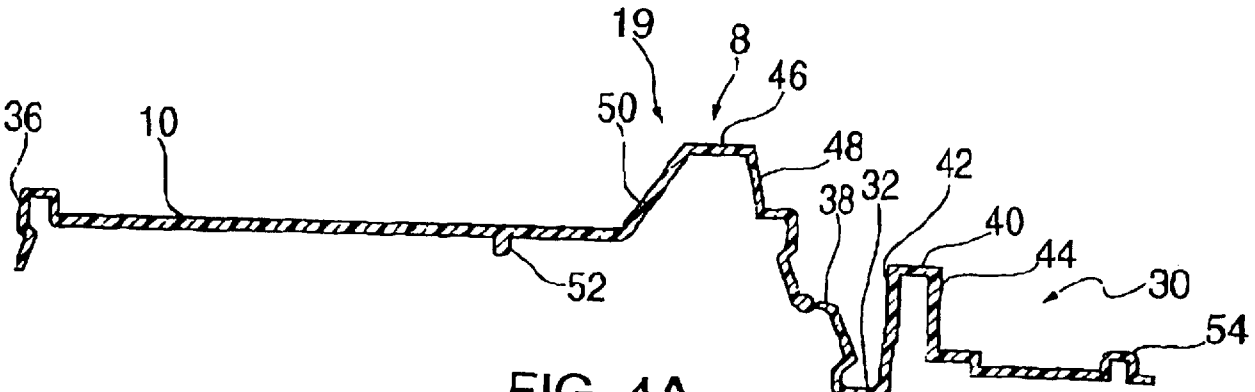
FIGS. 4A–4C are cross-sections of the lid assembly of the present invention along the lines 4A–4A of FIG. 3 and illustrate the assembly process in accordance with the present invention.
Figure 4B:
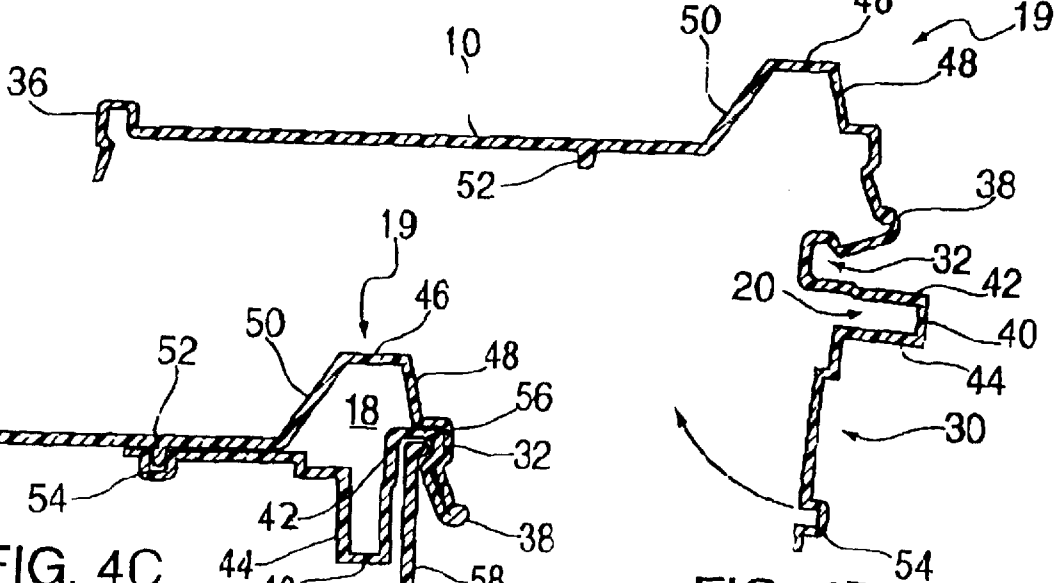
Figure 4C:
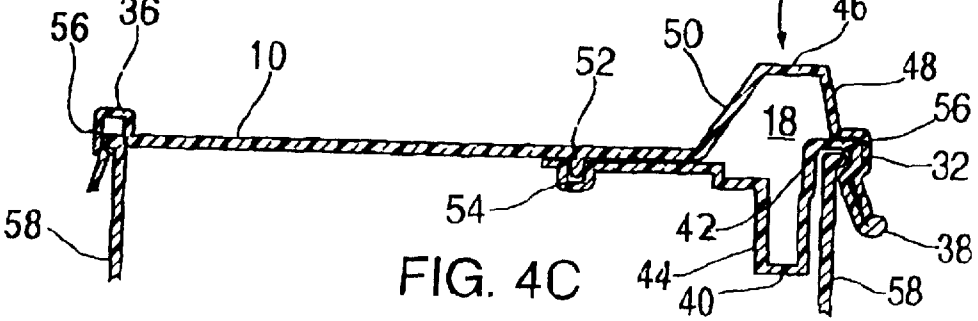

FIG. 4A illustrates a cross-section of unassembled lid 8 of the present invention. As shown therein, bottom section 30 is connected to disc 10 by joint 38. Joint 38 is a conventional weak spot which allows for the rotation of bottom section 30 under disc 10 as shown in FIGS. 4B and 4C.

Bottom portion 20 has bottom wall 40 and lower side walls 42 and 44. Top portion 19 has top wall 46 and upper side walls 48 and 50. When bottom section 30 is rotated around joint 38, bottom wall 40, top wall 46, lower side walls 42, 44 and upper side walls 48, 50 form tube 18.

It is preferred that bottom section 30 is securely fixed to disc 10 by means of a latch mechanism which is illustrated as projection 52 and channel 54. It will be understood, however, that such a latching mechanism is not necessary because, when bottom section 30 is rotated about joint 38 so as to join bottom section 30 to the underside of disc 10, the force between the rim of the cup and snap fitting periphery portion 32 is enough to maintain the engagement between disc 10 and bottom section 30. It will be appreciated that the rim of the cup forces snap fitting periphery portion 32 up to and against disc 10 as shown in FIG. 4C. Rim 56 of cup 58 is illustrated in FIG. 4C.

It should be appreciated that although only two inlets 21 and 22 are illustrated, additional inlets in tube 18 may be employed. Specifically, there can be inlets in lower end walls 60 and 62 of tube 18. Lower end walls 60 and 62 are illustrated in FIG. 2.

It will also be appreciated that although FIG. 3 illustrates that bottom section 30 is positioned directly opposite drinking hole 14, joint 38 can be at another location along the periphery of disc 10, provided that when section 30 is rotated about joint 38, bottom portion 20 aligns with top portion 19 to form tube 18.

It will also be noted in FIGS. 4A–4C that disc 10 has no snap fitting periphery in the area in which snap fitting periphery portion 34 resides. Thus, disc 10 has no snap fitting periphery along a portion of its periphery, that portion being the portion which is filled by snap fitting periphery portion 34 upon rotation of bottom section 30 against disc 10.

Obviously, the dimensions of the lid assembly are adjusted accordingly depending on the size of the cup. Typically, disposable cups are made in three sizes, small, medium and large. The lid of the present invention will have its dimensions adjusted accordingly for each one of the cup dimensions.

The lid assembly of the present invention is made in any conventional plastic molding process wherein the lid assembly is molded in a one-step molding operation in a conventional manner using conventional equipment.

It will be appreciated by those of skill in the art that lid 8 in the unassembled form, i.e. lid assembly as shown in FIGS. 3 and 4A, easily nest with one another. This is important for the purposes of shipping the lids to different users. As will be appreciated, the unassembled lid 8 takes up less volume than the assembled lid 8 as shown in FIGS. 1, 2 and 4C.

It will be appreciated that it is preferred that disc 10 employ a moat as shown in FIG. 1 so as to catch any liquid that may escape from drinking hole 14. This moat is not essential and need not be present in the invention as shown in FIGS. 4A–4C.

It will also be appreciated that the cross-sectional dimensions of tube 18 may be rounded as shown in FIGS. 1 and 2, or may be rectangular in shape as shown in FIGS. 4A–4C.

It will be understood that the claims are intended to cover all changes and modifications of the preferred embodiments of the invention herein chosen for the purpose of illustration which do not constitute a departure from the spirit and scope of the invention.

What is claimed is:

1. A splash-proof lid for a drinking cup comprising:

a circular disc having a snap fitting periphery for engagement with a cup rim;

an air hole in said disc which is positioned in the center of said disc;

an arched tube adjacent said snap fitting periphery, said tube having a radius that is concentric with the radius of said disc and less than the radius of said disc, said tube having a top portion which is above the top surface of said disc and a bottom portion which is below the bottom surface of said disc;

a drinking hole in a top wall of said tube, said tube centered on said drinking hole, said air hole being smaller than said drinking hole;

at least two inlets in said tube positioned in said bottom portion of said tube, such that said inlets are in fluid communication with said drinking hole to allow a user to drink through the lid when the lid is placed on top of a drinking cup.

2. The lid of claim 1 wherein said inlets are in a bottom wall of said tube.

3. The lid of claim 1 wherein said inlets are in an end wall of said bottom portion of said tube.

4. The lid of claim 1 wherein said arched tube forms an angle of about 30° to about 60°.

5. The splash-proof lid assembly of claim 1 wherein said tube forms an angle of about 30° to about 60°.

6. The splash-proof lid assembly of claim 1 wherein said disc has a projection and said bottom section has a channel which mates with said projection when said bottom section is rotated to mate with the underside of said disc.

7. The lid of claim 1 wherein said inlets are in an end wall of said tube bottom portion.

8. A splash-proof lid assembly for making a lid for use with a drinking cup comprising:

a circular disc having a periphery;

a first snap fitting periphery portion which extends around a first portion of said periphery, said first snap fitting periphery portion being absent from a second portion of said periphery;

a tube top portion with a drinking hole therein, said tube top portion positioned adjacent to said periphery at said second portion of said periphery, said tube top portion rising above the top surface of said disc;

an air hole positioned in the center of said disc;

a bottom section having an arcuate side, said bottom section having a second snap fitting periphery portion which is adjacent said arcuate side and a tube bottom portion having at least two inlets therein, said tube bottom portion adjacent said second snap fitting periphery portion, said bottom section rotatably attached to said disc along said periphery of said disc such that when said bottom section is rotated under said disc, said second snap fitting periphery portion is positioned in said second portion of said periphery and said tube bottom portion aligns with said tube top portion to form an arched tube in said lid, said inlets are in fluid communication with said drinking hole, and said first snap fitting periphery portion and said second snap fitting periphery portion for a complete snap fitting periphery of said lid.

9. The lid assembly of claim 8, wherein said inlets are in a bottom wall of said tube bottom section.

* * * * *